US010400561B2

(12) United States Patent
Nasr et al.

(10) Patent No.: US 10,400,561 B2
(45) Date of Patent: Sep. 3, 2019

(54) METHOD FOR ACCELERATING HEAVY OIL PRODUCTION

(71) Applicant: CONOCOPHILLIPS COMPANY, Houston, TX (US)

(72) Inventors: Tawfik Noaman Nasr, Katy, TX (US); David A. Brown, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 13/742,518

(22) Filed: Jan. 16, 2013

(65) Prior Publication Data

US 2013/0180712 A1 Jul. 18, 2013

Related U.S. Application Data

(60) Provisional application No. 61/587,735, filed on Jan. 18, 2012.

(51) Int. Cl.

| | |
|---|---|
| ***E21B 43/16*** | (2006.01) |
| ***E21B 43/17*** | (2006.01) |
| ***E21B 43/24*** | (2006.01) |

(52) U.S. Cl.

CPC ..... *E21B 43/166* (2013.01); *E21B 43/17* (2013.01); *E21B 43/2408* (2013.01)

(58) Field of Classification Search

CPC .. E21B 43/24; E21B 43/2406; E21B 43/2408; E21B 43/166; E21B 43/168

USPC ..... 166/275, 272.3

See application file for complete search history.

(56) References Cited

U.S. PATENT DOCUMENTS

| | | | | |
|---|---|---|---|---|
| 4,120,357 | A * | 10/1978 | Anderson | 166/272.3 |
| 4,635,720 | A * | 1/1987 | Chew | 166/245 |
| 4,846,275 | A * | 7/1989 | McKay | 166/402 |
| 5,215,146 | A * | 6/1993 | Sanchez | C09K 8/592 166/272.3 |
| 6,119,776 | A * | 9/2000 | Graham | E21B 43/17 166/245 |
| 6,186,232 | B1 * | 2/2001 | Isaacs | E21B 43/16 166/272.3 |
| 6,988,549 | B1 * | 1/2006 | Babcock | E21B 43/2406 166/267 |
| 7,441,603 | B2 * | 10/2008 | Kaminsky | E21B 43/2405 166/266 |
| 7,647,966 | B2 * | 1/2010 | Cavender | E21B 43/305 166/250.01 |
| 8,656,998 | B2 * | 2/2014 | Dong | E21B 43/2408 166/272.3 |
| 2005/0045325 | A1 * | 3/2005 | Yu | E21B 43/2406 166/245 |
| 2008/0251255 | A1 | 10/2008 | Forbes | |

(Continued)

FOREIGN PATENT DOCUMENTS

| | | |
|---|---|---|
| CA | 2713619 | 4/2011 |
| CA | 2788894 | 10/2011 |

(Continued)

*Primary Examiner* — Angela M DiTrani Leff
(74) *Attorney, Agent, or Firm* — Boulware & Valoir

(57) ABSTRACT

A method of drilling a first well and a second well into the reservoir includes forming a conduit between the first well and the second well. The conduit is filled with a conduit material. Finally, a low viscosity fluid is injected into the conduit to establish fluid communication between the first well and the second well.

17 Claims, 9 Drawing Sheets

(56) References Cited

U.S. PATENT DOCUMENTS

| | | | | |
|---|---|---|---|---|
| 2008/0289822 | A1 | 11/2008 | Betzer Tsilevich | |
| 2009/0260811 | A1* | 10/2009 | Cui et al. | 166/272.3 |
| 2011/0247819 | A1* | 10/2011 | Nguyen | E21B 43/24 166/302 |
| 2011/0272153 | A1* | 11/2011 | Boone et al. | 166/270 |
| 2012/0085529 | A1* | 4/2012 | Tunney et al. | E21B 43/2406 166/50 |

FOREIGN PATENT DOCUMENTS

| | | |
|---|---|---|
| CA | 2752461 | 3/2012 |
| CN | 101482003 | 7/2009 |

* cited by examiner

METHOD FOR ACCELERATING HEAVY OIL PRODUCTION

CROSS-REFERENCE TO RELATED APPLICATIONS

This application is a non-provisional application which claims benefit under 35 USC § 119(e) to U.S. Provisional Application Ser. No. 61/587,735 filed Jan. 18, 2012, entitled "A Method for Accelerating Heavy Oil Production," which is incorporated herein in its entirety.

STATEMENT REGARDING FEDERALLY SPONSORED RESEARCH OR DEVELOPMENT

None.

FIELD OF THE INVENTION

This invention relates to a method for accelerating heavy oil production.

BACKGROUND OF THE INVENTION

In many areas of the world, large deposits of viscous petroleum exist, and these deposits are often referred to as heavy oil deposits due to the high viscosity of the hydrocarbons in which they contain. These heavy oils may extend for many miles and occur in varying thicknesses of up to more then 300 feet. Although heavy oil deposits may lie at or near the earth's surface, generally they are located under a substantial overburden which may be as great as several thousand feet thick. Heavy oils located at these depths constitute some of the world's largest presently known petroleum deposits. The heavy oil's contain a viscous hydrocarbon material, commonly referred to as bitumen, in an amount which typically ranges from about 5 to about 20 percent by weight. While bitumen is usually immobile at typical reservoir temperatures, the bitumen generally becomes mobile at higher temperatures and has a substantially lower viscosity at higher temperatures than at the lower temperatures.

Since most heavy oil deposits are too deep to be mined economically, conventional technology utilizes an in situ recovery process wherein the bitumen is separated from the sand in the formation and produced through a well drilled into the deposit. Two basic technical requirements must be met by any in situ recovery process: (1) the viscosity of the bitumen must be sufficiently reduced so that the bitumen will flow to a production well; and (2) a sufficient driving force must be applied to the mobilized bitumen to induce production.

In typical heavy oil reservoirs, the mobility of the oil is too low to allow oil production at practical and economic rates. In this case, methods to reduce the viscosity of the oil or enhance permeability are used to improve oil mobility. Methods of lowering oil viscosity include hot water, steam, solvent or stream plus solvent injection. Methods for enhancing permeability include dilation of the hydrocarbon reservoir formation or fracturing. Without the ability to achieve fluid mobility and communication between injection and production wells, any practical driving force between the injection and production wells results in very low oil rates (1 to 2 bbl/d).

Hydrocarbon recovery may be enhanced in certain heavy oil and bitumen reservoirs by using a process such as steam assisted gravity drainage (SAGD). When using SAGD, horizontal, production and steam injection wellbores are drilled into the hydrocarbon reservoir formations and steam is injected into the steam injection wellbore. The production and steam injection wellbores are generally spaced in the vertical direction by 5 m, and the injection of steam into the steam injection wellbore causes the heavy hydrocarbons to become mobile and produced in the production wellbore due to the reduction of in situ viscosity. The benefits of SAGD over conventional secondary thermal recovery techniques such as steam drive and cyclic steam stimulation include higher oil productivity relative to the number of wells employed and higher ultimate recovery of oil in place.

Unfortunately, SAGD and other heavy oil recovery systems have been hampered by the long pre-heating stage that is often required to mobilize the oil between the injection and production wells. This pre-heating stage often requires anywhere from 3 months up to nine months or longer of pre-heating to heat the bitumen in the formation to a point where it can flow. Furthermore, attempts to start a SAGD process have determined that it is limited to formations where a vertical permeability is greater than 1 Darcy.

There exists a need for a method of heavy oil recovery without a pre-heating stage and that would be applicable in all heavy oil situations.

BRIEF SUMMARY OF THE DISCLOSURE

The present embodiment describes a method of drilling a first well and a second well into the reservoir. A conduit is then formed between the first well and the second well. The conduit is filled with a conduit material. Finally, a low viscosity fluid is injected into the conduit to establish fluid communication between the first well and the second well.

In an alternate embodiment, a method is taught of drilling an injection well and a production well. After the injection well and the production well are in place, a conduit is created between the injection well and the production well. The conduit is then filled with a conduit material. A low viscosity fluid is injected into the conduit to establish fluid communication between the injection well and the production well. Afterwards, an injection fluid can be introduced into the conduit to facilitate the production of hydrocarbons.

In yet another embodiment, a method is taught of drilling an injection well and a production well. After the injection well and the production well are in place, a conduit is created between the injection well and the production well. The conduit is then filled with a conduit material. A low viscosity fluid is injected into the conduit to establish fluid communication between the injection well and the production well. Afterwards, an injection fluid is introduced into the conduit to facilitate the production of hydrocarbons by steam assisted gravity drainage or other in-situ heavy oil production methods absent the need of a pre-heating phase.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Figure 1:
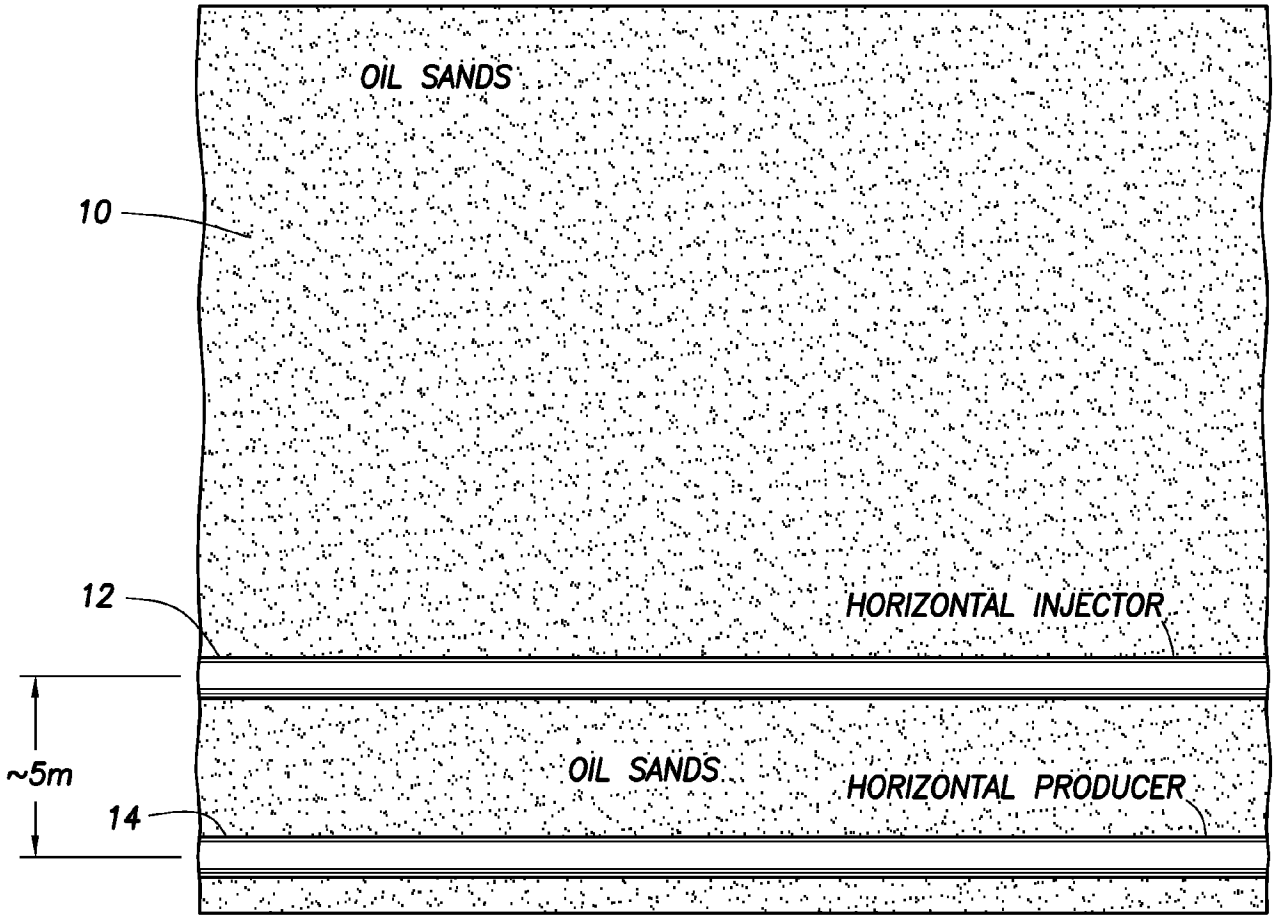
FIG. 1 depicts a typical steam assisted gravity drainage process.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment describes a method of drilling a first well and a second well into the reservoir. A conduit is then formed between the first well and the second well. The conduit is filled with a conduit material. Finally, a low viscosity fluid is injected into the conduit to establish fluid communication between the first well and the second well.

The first well and the second well can be used for any typically known enhanced oil recovery process that is for producing oil in heavy oil. Different types of enhanced oil recovery process where this method could be implemented include steam assisted gravity drainage (SAGD), expanded solvent-steam assisted gravity drainage (ES-SAGD), cyclic steam stimulation (CSS), steam drive, in-situ combustion, VAPEX, cyclic solvent injection, hot water injection, hot water-additive injection or toe to heel air injection. With these different enhanced oil recovery processes the wells can be vertical, horizontal, deviated or a combination.

The drilling of the first well and second well can either be done simultaneously or one after the other. The specifics as to determining which well to drill first or whether or not to drill them simultaneously would rely upon the specifics of the reservoir to be drilled.

In one embodiment, the formation of the conduit can be formed before, during or after the first well and the second well are drilled. The formation of the conduit can be placed along the entire horizontal length of the first well and the second well. In other embodiments, the conduit is placed along select points to connect the first well and the second well. The formation of the conduit can be established through drilling and completion or any other known conventional means.

In typical enhanced oil recovery systems such as SAGD, the vertical spacing between the horizontal wells are limited to 5 meters or less. While this method is capable of operating with horizontal wells less than 5 meters, this method is also capable of operating in wells greater than 5 meters by placing a conduit between the horizontal wells. In some embodiments, the vertical spacing between the horizontal wells can range from 6, 8, 10, 15 even 20 meters apart or the conduit may extend to the top of the pay of the reservoir.

In some embodiments, the first well is a vertical injection well which is used at the top of the bitumen and the second well is a horizontal production well closer to the bottom of the bitumen. In one embodiment, the conduit can be used to connect between the vertical injection well and the horizontal production well.

The conduit can be sized to fit any type of enhanced oil recovery system. The thickness of the conduit can vary anywhere from 0.1, 0.15, 0.2, 0.25, 0.5, 0.75 even up to 1.0 meters in thickness. The height of the conduit can vary anywhere from 1, 2, 5, 7, 10, 15, even 20 meters in height or extend to the top of the pay of the reservoir. The length of the conduit would vary upon the configuration of the first well and the second well. As described above, the length of the conduit can run along the entire length of the horizontal wells or along part of the length of the horizontal wells or be sized to the intersection between a vertical injection well and a horizontal injection well or a vertical injection well and a horizontal production well.

When the conduit has been formed, it can be filled with a conduit material. The conduit material is typically chosen from materials which would create channels to flow through the conduit. Examples of various conduit materials include sand, zircon, gravel, glass, aluminum, walnut shells, ceramic materials and combinations of these materials.

After the conduit has been filed with a conduit material, a low viscosity fluid can be injected into the channels in the conduits to create a fluid communication between the first well and the second well. A wide variety of low viscosity fluids can be used for the production of heavy oil including water, light oils, solvent or gas or their combinations. Solvents used may include $C_2$-$C_{30}$ and their combinations, naphtha, diluents, aromatic solvents (such as toluene and xylene) and other carbonless solvents. Additionally, gases such as $CO_2$, flue gas (from down hole steam generators or steam boilers), methane or combinations of these gases can be used.

In an alternate embodiment, a method is taught of drilling an injection well and a production well. After the injection well and the production well are in place a conduit is created between the injection well and the production well. The conduit is then filled with a conduit material. A low viscosity fluid is injected into the conduit to establish fluid communication between the injection well and the production well. Afterwards, an injection fluid can be introduced into the conduit to facilitate the production of hydrocarbons.

In one embodiment, injection fluids can include fluids such as water, air, steam, gases, light oils, chemicals, solvents or combinations of these fluids. Solvents used may include $C_2$-$C_{30}$ and their combinations, naphtha, diluents, aromatic solvents (such as toluene and xylene) and other carbonless solvents. Chemical agents such as surfactants can be used. Additionally, gases such as $CO_2$, flue gas (from down hole steam generators or steam boilers), methane or combinations of these gases can be used. These injected fluids can be injected with a hot fluid such as hot water or steam in a continuous matter. An alternative injection strategy may include injecting either or both additives intermittently or sequentially at different time intervals.

In an alternate embodiment, the production of hydrocarbons can occur absent a pre-heating stage. By eliminating the pre-heating stage, the production of hydrocarbons can occur within 1, 2 or even 3 days after drilling the wells.

In yet another embodiment, a method is taught of drilling an injection well and a production well. After the injection well and the production well are in place, a conduit is created between the injection well and the production well. The conduit is then filled with a conduit material. A low viscosity fluid is injected into the conduit to establish fluid communication between the injection well and the production well. Afterwards, an injection fluid is introduced into the conduit to facilitate the production of hydrocarbons by steam assisted gravity drainage (SAGD) or expanding solvent steam assisted gravity drainage (ES-SAGD) absent the need of a pre-heating phase.

FIG. 1 depicts example 1, a typical steam assisted gravity drainage process in a reservoir 10. In this process, two wells 12 and 14 are drilled into the formation wherein the distance between the top well and the bottom well is about 4 to 6 meters. In this embodiment, the upper well injects steam, possibly mixed with solvents, and the lower well collects the heated crude oil, heavy oil or bitumen that flows out of the formation, along with any water from the condensation of injected steam. Typically, the start-up phase for heating this type of reservoir with steam can take anywhere from 2 months to 3 months or longer. Additionally, the conventional maximum distance between the upper well and the lower well is around 5 meters.

Figure 2:
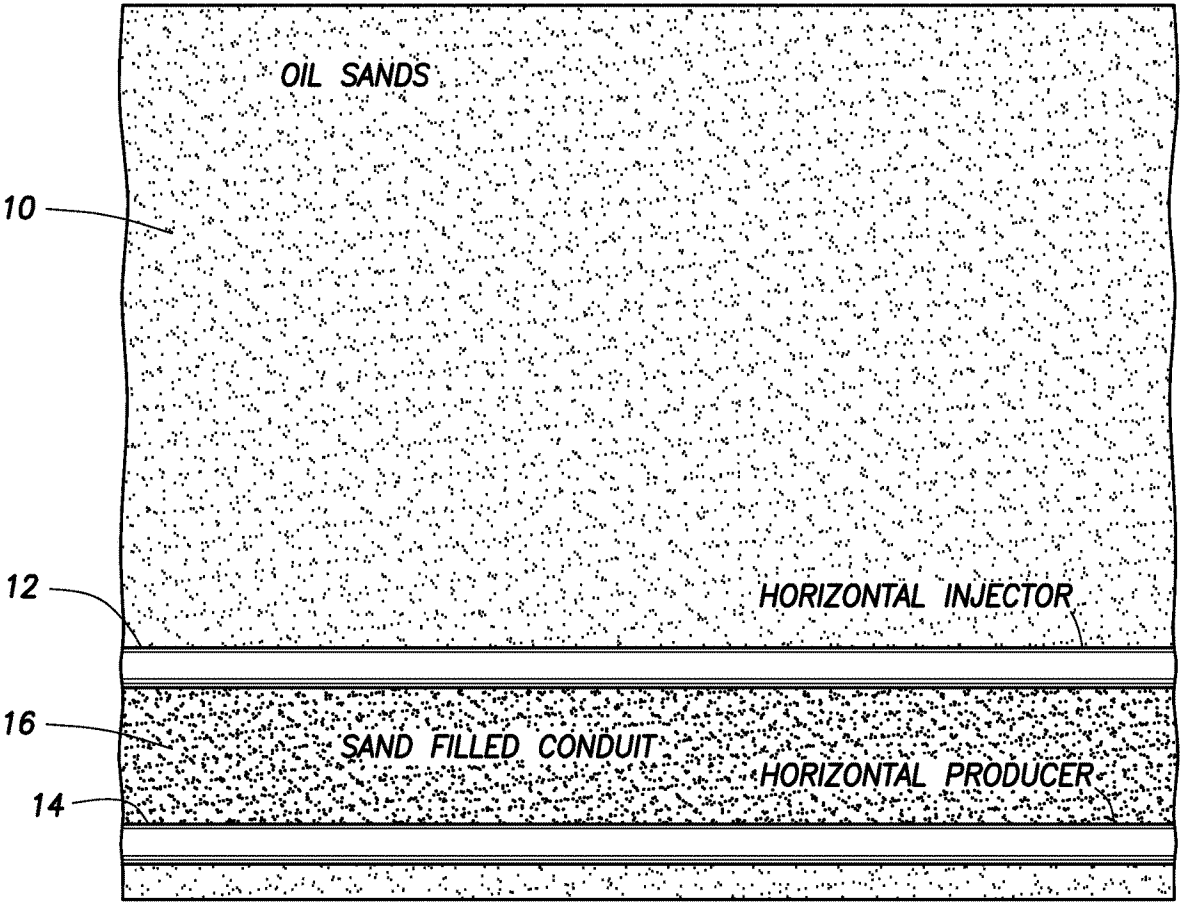
FIG. 2 depicts a steam assisted gravity drainage process with a conduit between the wells.

FIG. 2 depicts example 2, the situation wherein a conduit 16 is placed between the two wells in a reservoir 10. In this embodiment, it is depicted that the conduit extends all the way from the lower well 14 to the upper well 12. The distance between the upper well and the lower well can be anywhere from 0.1, 3, 5, or even 7 or 10 meters in distance.

Other embodiments of this design are feasible where the conduit does not connect to the upper well or the lower well or it only connects to one well. For example in one situation it would be feasible to have from 0.1 to 6 meters of reservoir between the lower well and the conduit. In another example it would be feasible to have from 0.1 to 6 meters of reservoir between the upper well and the conduit. The conduit can extend along the entire length of the horizontal wells or extend over some parts along the length of the horizontal wells.

FIGS. 3, 4, 5, 6 depict a comparison of well bottom-hole pressure, comparison of steam rates, comparison of oil rates, and a comparison of cumulative oil between operating a typical SAGD production and one where a conduit is placed between the two wells.

In both simulations, an Athabasca oil sands reservoir of 121 meters in width by 30 meters in height and 500 meters in length was used for the simulation. Two 500 meter long wells were placed near the bottom and in the middle of the reservoir and separated by 5 meters in the vertical direction. The lower well was placed 1 meter above the bottom of the oil bearing sands. In these simulations, both the upper and lower wells are horizontal.

In this baseline simulation, a SAGD production was simulated without a conduit. In this simulation, a pre-heating period of 195 days was required to heat the region between the wells by circulating steam in both the injection and production wells. Following the pre-heating phase, steam was injected into the upper well and heavy oil was produced from the lower well. In this simulation, a bottomhole injection pressure of 3.5 MPa was utilized.

An alternate simulation was conducted simulating a SAGD production with a conduit placed between the wells, a conduit of 0.2 meters in thickness, 5 meters in height, and 500 meters in length was drilled connecting the two horizontal wells over their entire length. This conduit was packed with clean sand with a porosity of 0.33 and a permeability similar to that of the reservoir, around 3 darcy. A conduit with a permeability similar to that of the reservoir is one that is within 1 darcy of the reservoir. In other embodiments, the permeability of the conduit may be anywhere from 0.01, 0.1, 0.5, 1.0 or even 1.5 darcy to that of the reservoir. A low viscosity fluid of water was then saturated into the conduit. After the saturation, an injection fluid of steam was injected into the upper well and heavy oil was produced from the lower well. In this simulation, a bottomhole injection pressure of 3.5 MPa was utilized.

Figure 3:
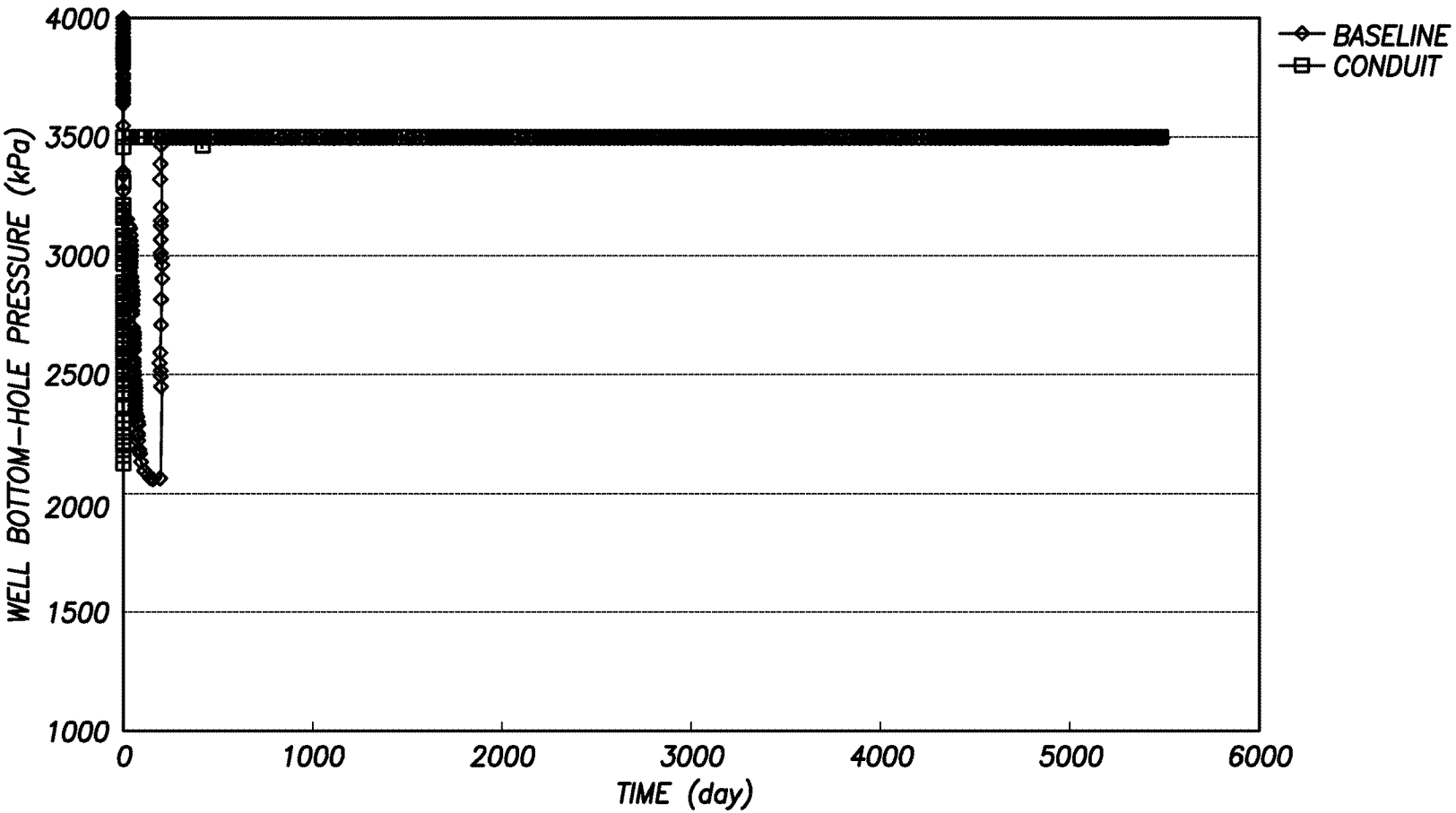
FIG. 3 depicts a comparison of well bottom-hole pressure in a typical steam assisted gravity drainage production against a steam assisted gravity drainage production with a conduit placed between the wells.

FIG. 3, depicts a comparison of well bottom-hole pressure in a typical SAGD production against a SAGD production with a conduit placed between the wells. In this figure, it is shown that conventional SAGD takes anywhere from 25 to over 100 days for the well bottom-hole pressure to reach 3500 kPa while a SAGD production with a conduit takes significantly less time.

Figure 4:
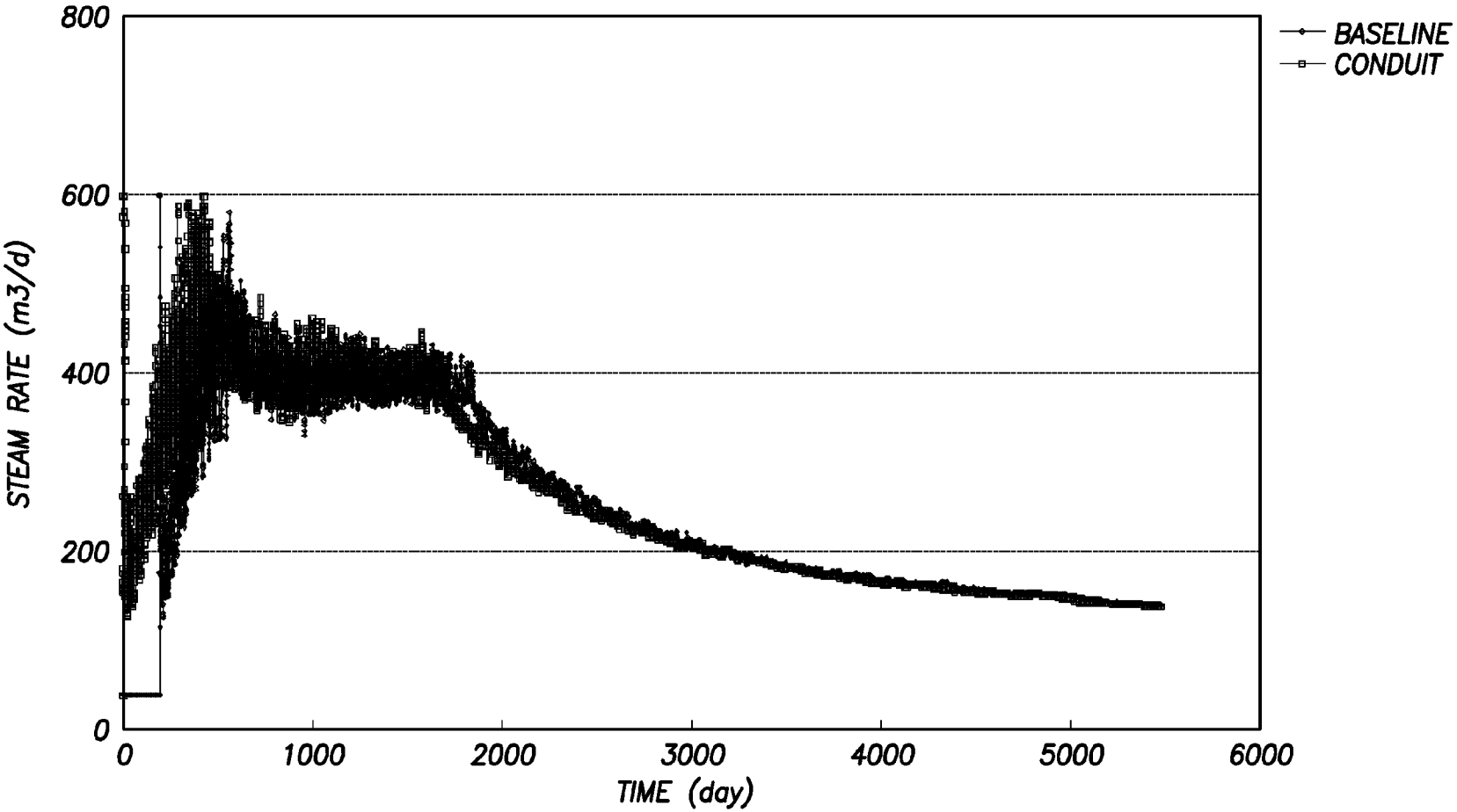
FIG. 4 depicts a comparison of steam rates in a typical steam assisted gravity drainage production against a steam assisted gravity drainage production with a conduit placed between the wells.

FIG. 4 depicts a comparison of steam rates in a typical SAGD production against a SAGD production with a conduit placed between the wells. In this figure, it is shown that the steam rates rise faster with a SAGD production using a conduit than with conventional SAGD. Greater steam rates allow for faster start-up times.

Figure 5:
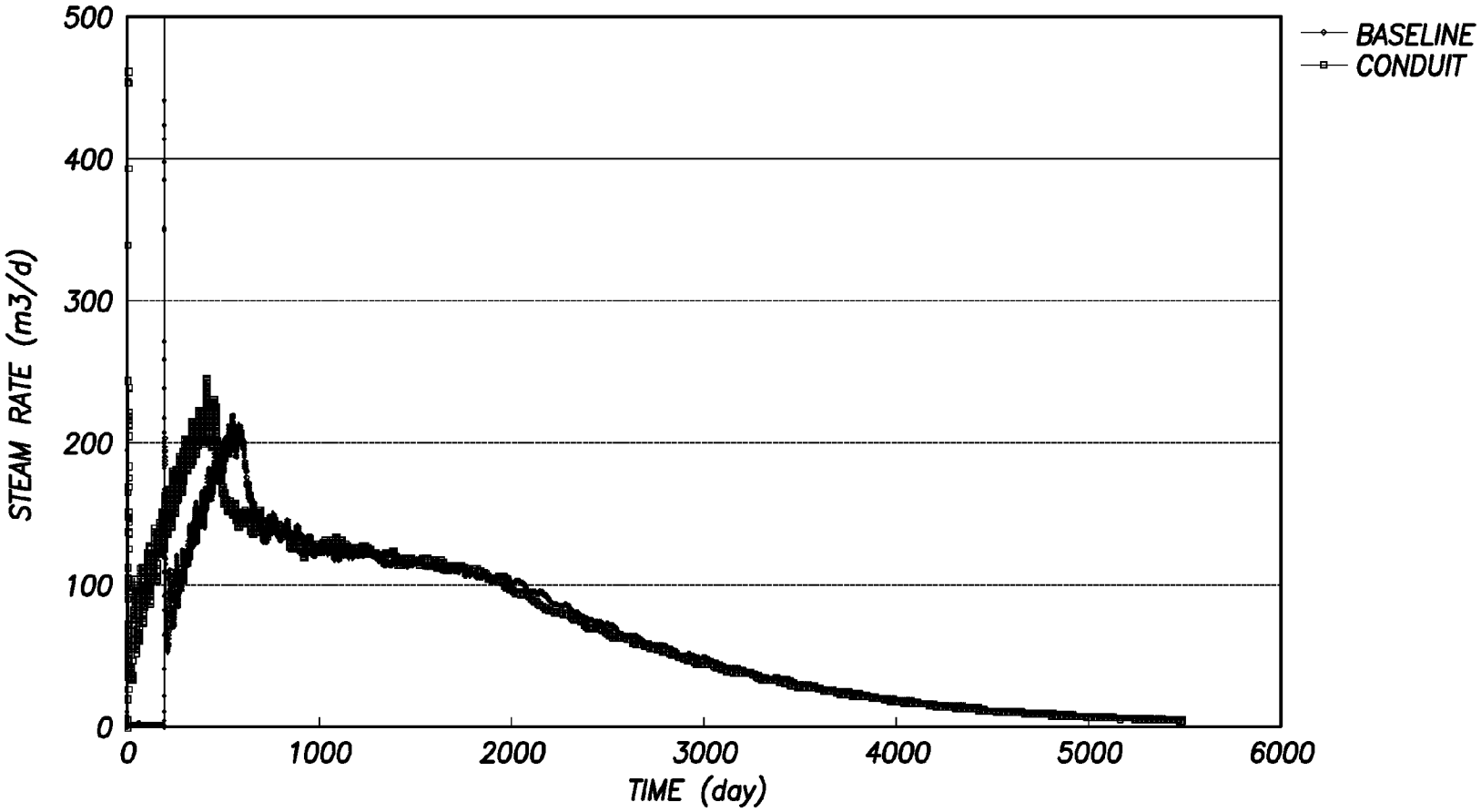
FIG. 5 depicts a comparison of oil rates in a typical steam assisted gravity drainage production against a steam assisted gravity drainage production with a conduit placed between the wells.

FIG. 5 depicts a comparison of oil rates in a typical SAGD production against a SAGD production with a conduit placed between the wells. In this figure, it is shown that the oil rates rises faster with a SAGD production using a conduit than with conventional SAGD. This graph establishes that oil can be produced faster when using SAGD with a conduit than operating SAGD without.

Figure 6:
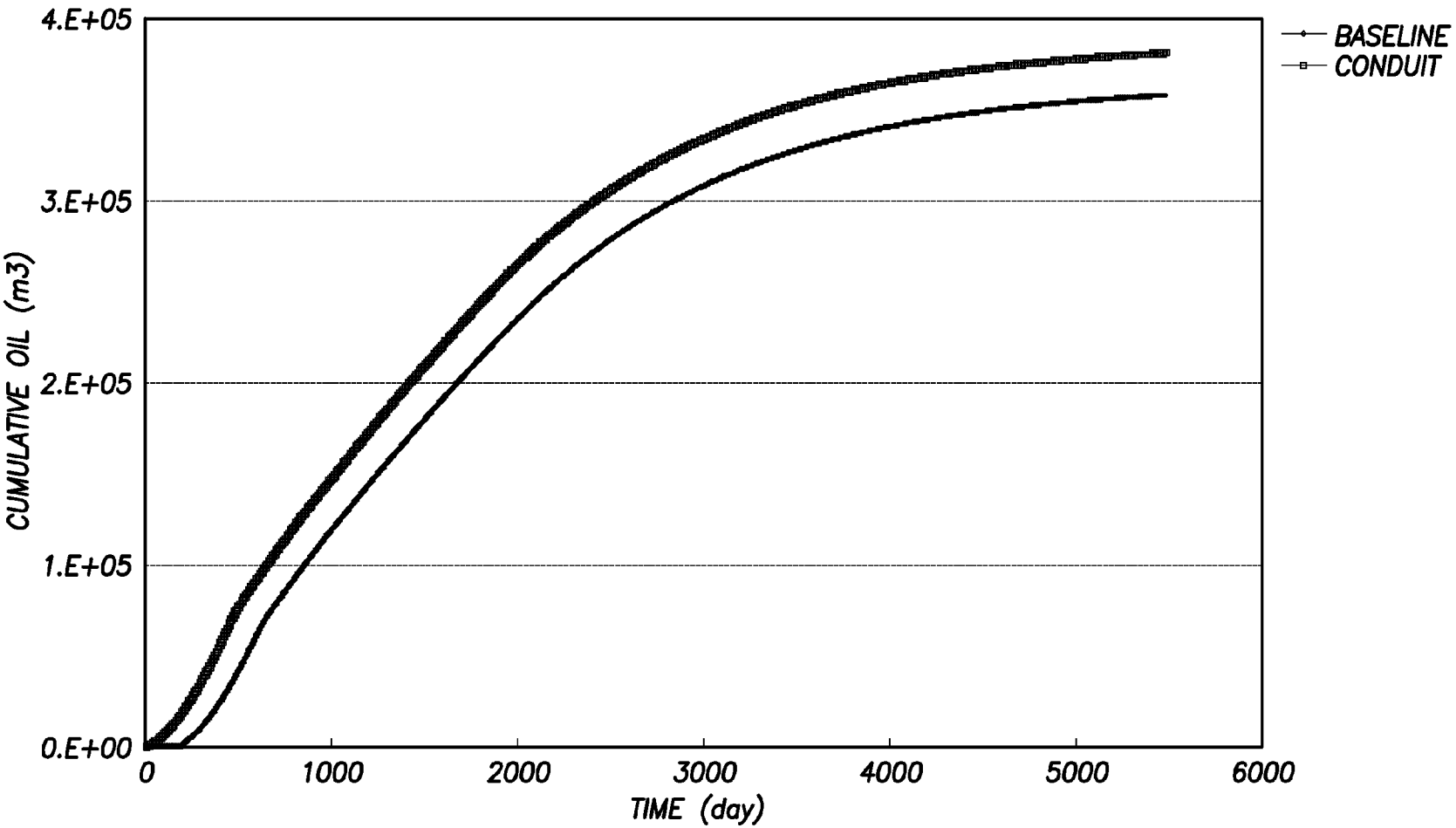
FIG. 6 depicts a comparison of cumulative oil in a typical steam assisted gravity drainage production against a steam assisted gravity drainage production with a conduit placed between the wells.

FIG. 6 depicts a comparison of cumulative oil in a typical SAGD production against a SAGD production with a conduit placed between the wells. In this figure, it is shown that the total amount of cumulative oil achieved is greater at the same time period with a SAGD production using a conduit than with conventional SAGD. Additionally, this figure also demonstrates that even though some of the reservoir is replaced with the conduit it does not diminish or lower the amount of cumulative oil achieved from the reservoir.

Figure 7:
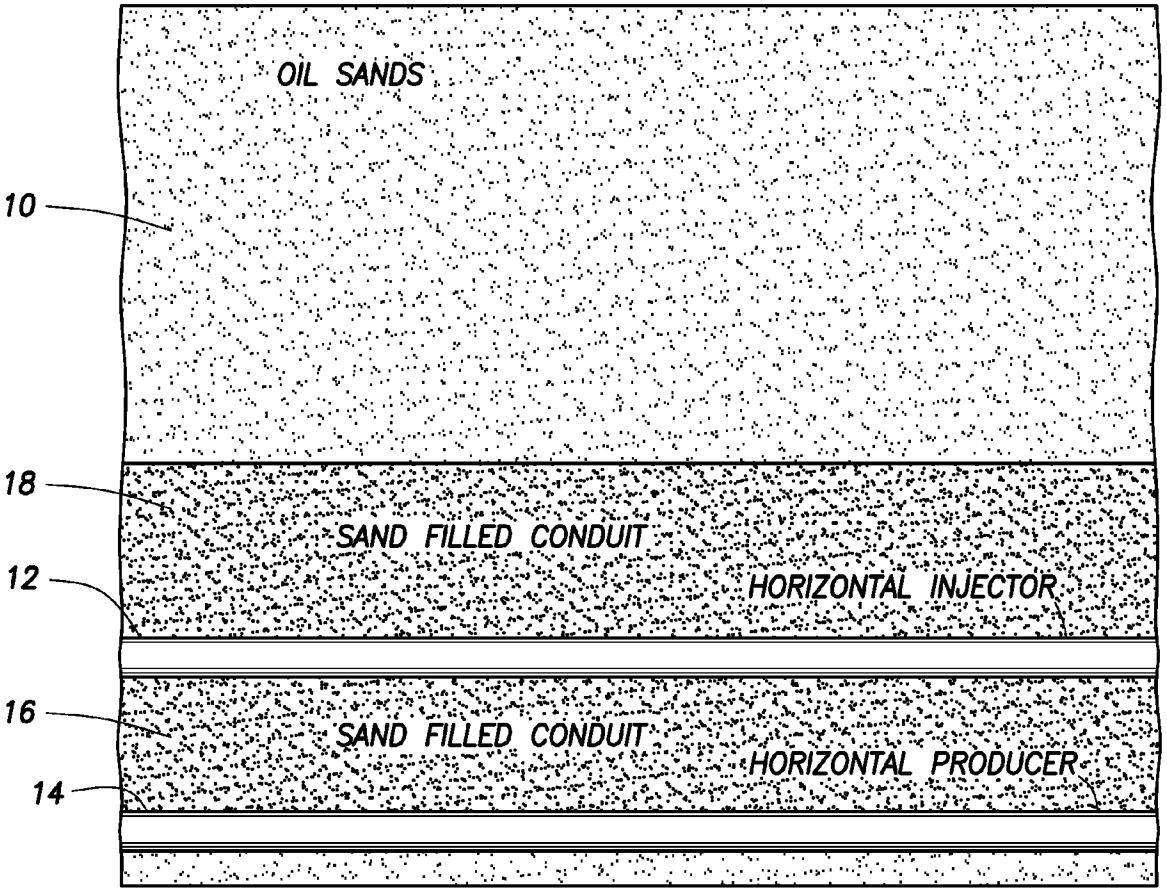
FIG. 7 depicts an example wherein the conduit extends vertically, both between the wells and also above the wells, as well as along the length of the wells.

FIG. 7 depicts an example wherein the conduit extends vertically, both between the wells and also above the wells, as well as along the length of the wells. In this situation, similar to FIG. 2, a conduit 16 is placed between the two wells 12 and 14. The difference between FIG. 2 and FIG. 7 is the additional conduit 18 that is placed above the upper well 12. In this example, the distance between the upper well to the top of the additional conduit 18 could be anywhere from 0.1 meters to 5 meters. The placement of the additional conduit 18 aids in the ability of the reservoir to produce more oil with a significantly reduced start-up phase.

Figure 8:
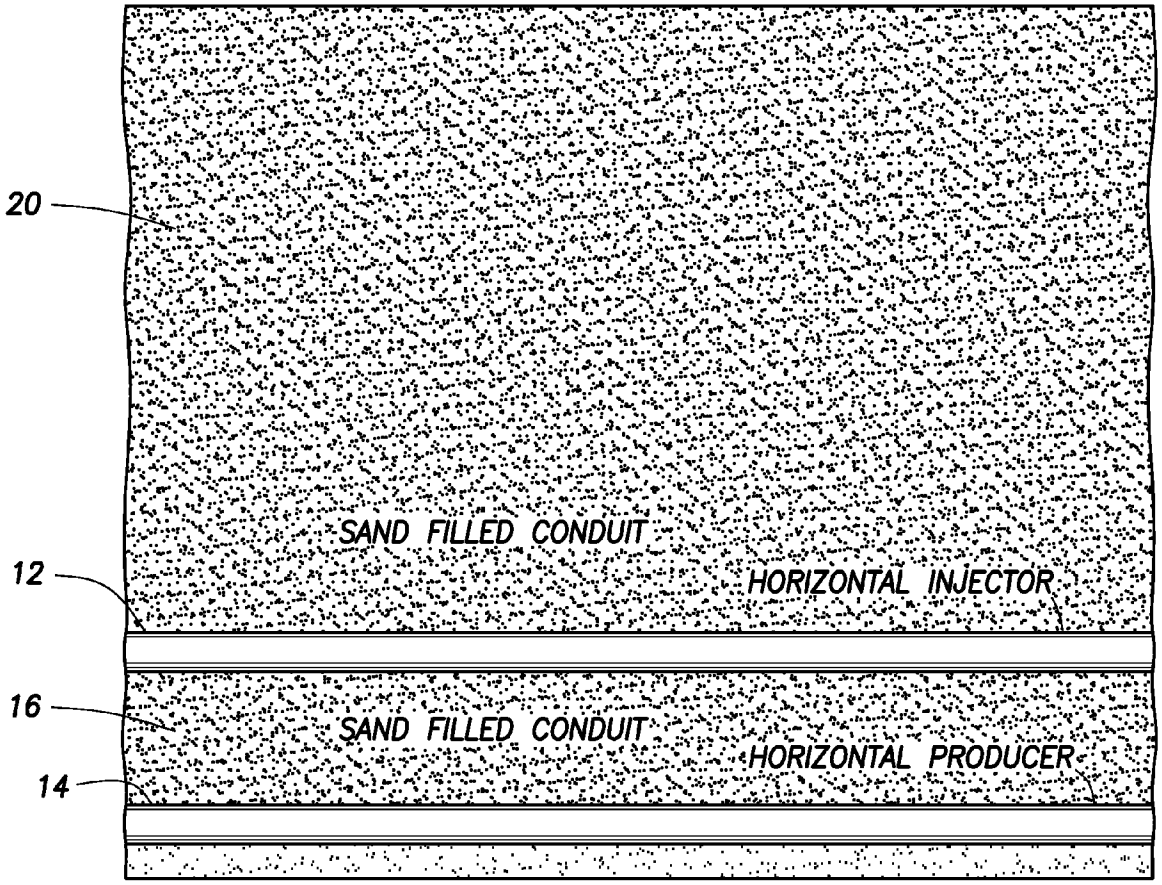
FIG. 8 depicts an example wherein the conduit extends along and between the wells and to the top of the pay of the reservoir.

FIG. 8 depicts an example wherein the conduit extends along and between the wells and to the top of the pay of the reservoir. In this situation, similar to FIG. 2, a conduit 16 is placed between the two wells 12 and 14. The difference between FIG. 2 and FIG. 8 is the additional conduit 20 that is placed above the upper well 12. The placement of the additional conduit 20 aids in the ability of the reservoir to produce even more oil with less of a start-up phase.

It is important to note that while FIGS. 2, 7 and 8 each depict different embodiments of how a conduit can be placed both above and between the wells it is possible to have the conduit extend outwards perpendicular to the wells. In these embodiments it is feasible that the outward extending conduits can either extend anywhere from 0.1 meters to 5 meters outside the width of the well.

Figure 9:
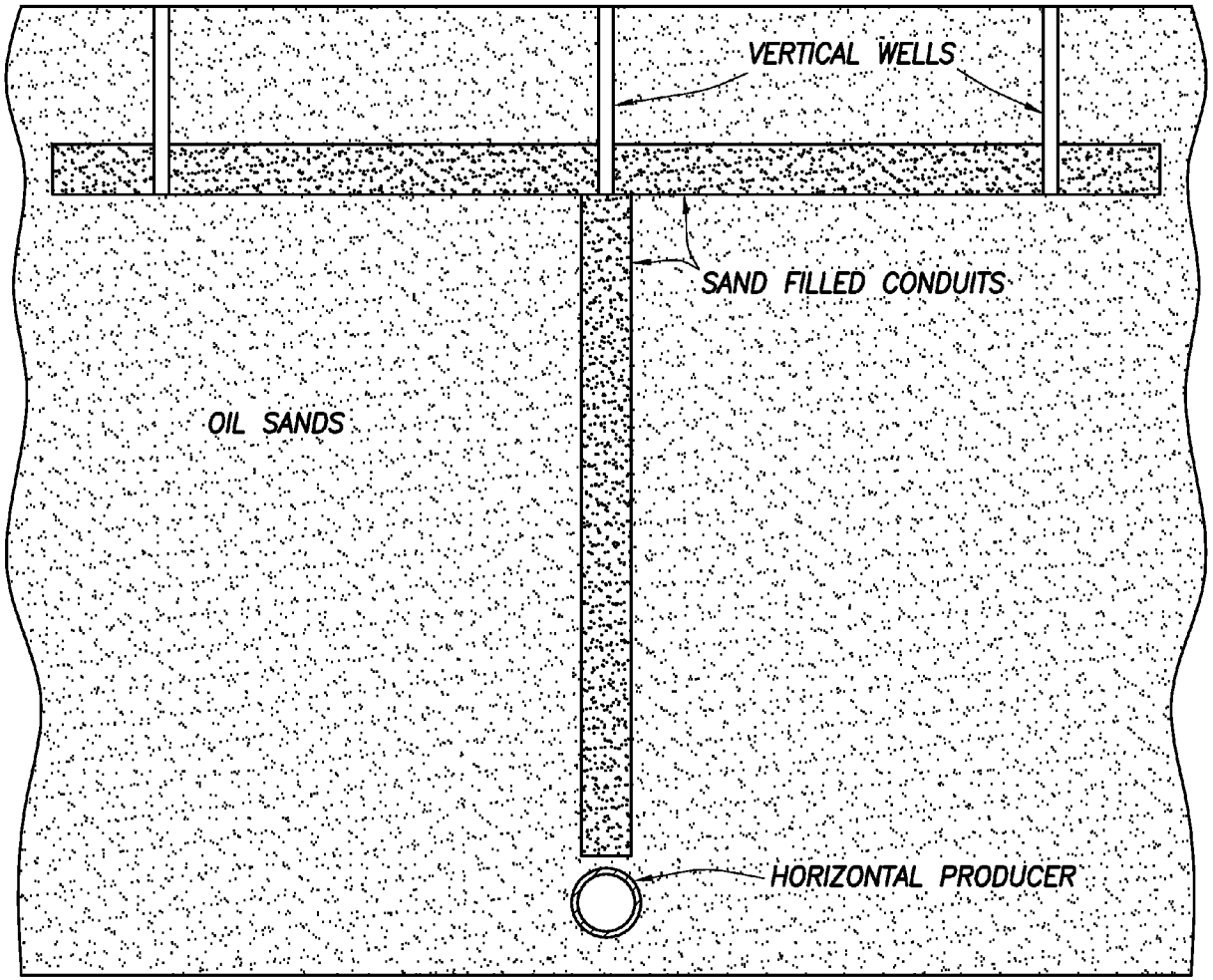
FIG. 9 depicts an example wherein the conduit extends above a horizontal producing well to the top of the pay of the reservoir and extends laterally to connect a number of vertical injectors.

In an alternate embodiment, it is also feasible to have a conduit between a vertical well and a horizontal well as illustrated in FIG. 9.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method comprising:

drilling a horizontal injection well and a horizontal production well into a heavy oil or bitumen reservoir;

drilling a conduit between the horizontal injection well and the horizontal production well, wherein said conduit extends along the length of the horizontal injection well and the horizontal production well;

filling the conduit with a conduit material;

injecting water, oil, solvent, or a combination thereof into the conduit to establish heavy oil or bitumen fluid communication between the horizontal injection well and the horizontal production well; and producing hydrocarbons by steam assisted gravity drainage (SAGD) wherein steam is injected into the injection well and heavy oil or bitumen is produced from the production well.

2. The method of claim 1, wherein the conduit connects the horizontal injection well and the horizontal production well along their entire horizontal length.

3. The method of claim 1, wherein the conduit connects the horizontal injection well and the horizontal production well at select points.

4. The method of claim 1, wherein the horizontal injection well and the horizontal production well are separated by greater than 5 meters.

5. The method of claim 1, wherein the horizontal injection well and the horizontal production well are separated by less than 5 meters.

6. The method of claim 1, wherein the conduit material is selected from the group consisting of sand, zircon, gravel, glass, aluminum, walnut shells, ceramic materials or combinations thereof.

7. The method of claim 6, wherein the conduit material creates a conduit with permeability within 1 darcy to the reservoir.

8. The method of claim 1, wherein the width of the conduit extends from 0.1 meters to 5 meters outside the width of the horizontal injection well or the horizontal production well.

9. A method comprising:

drilling an injection well and a horizontal production well in a heavy oil or bitumen reservoir;

drilling a conduit between the injection well and the horizontal production well;

filling the conduit with a conduit material;

injecting water, oil, solvent, or a combination thereof into the conduit to establish heavy oil or bitumen fluid communication between the injection well and the horizontal production well; and introducing an injection fluid into the conduit to facilitate the production of hydrocarbons by steam assisted gravity drainage (SAGD), wherein steam is injected into the injection well and heavy oil or bitumen is produced from the production well without a pre-heating stage.

10. The method of claim 9, wherein the conduit connects the injection well and the production well along their entire length.

11. The method of claim 9, wherein the conduit connects the injection well and the production well at select points.

12. The method of claim 9, wherein the injection well and the production well are separated by greater than 5 meters.

13. The method of claim 9, wherein the injection well and the production well are separated by less than 5 meters.

14. The method of claim 9, wherein the conduit material is selected from the group consisting of sand, zircon, gravel, glass, aluminum, walnut shells, ceramic materials or combinations thereof.

15. The method of claim 9, wherein the width of the conduit extends from 0.1 meters to 5 meters outside the width of the injection well or the production well.

16. The method of claim 9, wherein the injection well is a vertical well.

17. A method comprising:

drilling an injection well and a horizontal production well in a heavy oil reservoir;

drilling a conduit between the injection well and the horizontal production well;

filling the conduit with a conduit material;

injecting water, oil, solvent, or a combination thereof into the conduit to establish heavy oil fluid communication between the injection well and the horizontal production well;

introducing an injection fluid into the conduit; and injecting steam into the injection well to produce heavy oil through the production well by steam assisted gravity drainage without a pre-heating phase.

* * * * *